US012098572B1

(12) United States Patent
Sowers

(10) Patent No.: US 12,098,572 B1
(45) Date of Patent: Sep. 24, 2024

(54) FLOOD PREVENTION SYSTEM

(71) Applicant: Howard Sowers, Edgewater, FL (US)

(72) Inventor: Howard Sowers, Edgewater, FL (US)

( * ) Notice: Subject to any disclaimer, the term of this patent is extended or adjusted under 35 U.S.C. 154(b) by 0 days.

(21) Appl. No.: 18/219,657

(22) Filed: Jul. 8, 2023

(51) Int. Cl.
*E04H 9/14* (2006.01)

(52) U.S. Cl.
CPC ..... *E04H 9/145* (2013.01)

(58) Field of Classification Search
CPC ..... E06B 9/02; E06B 2009/007; E04H 9/145
See application file for complete search history.

(56) References Cited

U.S. PATENT DOCUMENTS

| | | | | |
|---|---|---|---|---|
| 3,861,081 | A | 1/1975 | Maskell | |
| 7,549,252 | B2 | 6/2009 | Vaughn | |
| 8,245,461 | B2 | 8/2012 | Wei | |
| 8,869,455 | B1 | 10/2014 | McFall | |
| 9,453,316 | B1 | 9/2016 | Cadogan et al. | |
| 10,844,563 | B1 | 11/2020 | Coleman | |
| 2004/0194426 | A1* | 10/2004 | Shapero | E06B 9/02 52/749.1 |
| 2019/0017315 | A1* | 1/2019 | Barresi | E04H 9/145 |

FOREIGN PATENT DOCUMENTS

| | | | | |
|---|---|---|---|---|
| GB | 2243393 A | * | 10/1991 | E06B 9/00 |
| GB | 2392194 A | * | 2/2004 | E06B 9/02 |
| GB | 2458211 A | * | 9/2009 | E06B 9/00 |

* cited by examiner

*Primary Examiner* — Christine T Cajilig
(74) *Attorney, Agent, or Firm* — Bold IP PLLC

(57) ABSTRACT

A flood prevention system is described. The flood prevention system includes a first bracket attached to a side wall adjacent to a left side beam of a doorway and a second bracket attached to a side wall adjacent to a right side beam of a doorway with a unique structure to accommodate receiving a first doorway barrier piece that is attachable to the first bracket and the second bracket and a second doorway barrier piece is attachable to the first bracket and the second bracket and faces towards the first doorway barrier piece when attached. One or more beams can be stacked either in a vertical or horizontal direction in the lip of the first doorway barrier piece. The second doorway piece can be used to add additional barrier protection and to test the first doorway barrier piece by pouring water into the lip of the second barrier piece.

13 Claims, 12 Drawing Sheets

FLOOD PREVENTION SYSTEM

FIELD OF THE DISCLOSURE

The present invention relates to a flood prevention system that integrates multiple barriers that are removable and that can be mounted and/or attached to brackets located adjacent to a door frame. The flood prevention system prevents water, whether due to flooding from natural disasters such as hurricanes or storms or other causes, from entering through a doorway of a home or business and damaging the home or business.

BACKGROUND

Flooding is still a grave concern to homeowners and business owners alike. The amount of damage and expenses associated with flooding of homes and/or businesses as well as associated insurance companies is often times very significant.

While there are various attempts that exist to minimize or prevent flooding of one's home or business, there are still several drawbacks to such existing commercially available options. One well-known option to minimize or prevent flooding is the use of sandbags that are used to barricade the doors. However, sandbags are notoriously heavy and bulky, and are not an item that many people can lift and put in place to build a high enough barrier. Additionally, having to remove soaked sandbags that are heavier with water after a flooding event happens is also extremely difficult. Some individuals barricade their doors with 2×4 beams directly to the door frame, but this damages the door frames and also is not enough of a barrier to prevent flooding water from seeping through the cracks of the door frame.

Accordingly, an improved system of preventing flooding for homes and business is still much needed.

SUMMARY

One or more embodiments are provided below for a method of using a flood prevention system comprising providing the flood prevention system. The flood prevention system may comprise a first doorway barrier piece comprising a solid first doorway barrier piece panel and a first doorway barrier piece bottom rail attached to a lower end of the first doorway barrier piece panel, wherein a first doorway barrier piece channel is formed between the bottom rail and the first doorway barrier piece panel, wherein the first doorway barrier piece channel is configured to receive a plurality of solid or hollow beams useful in preventing flood water from entering through a doorway. The second doorway barrier piece may comprise a solid second doorway barrier piece panel having a first beam member on a left side and a second beam member on a right side of the solid panel and a second doorway barrier piece bottom rail with a second doorway barrier piece bottom rail channel extending through the second doorway barrier piece bottom rail between a front surface of the solid second doorway barrier piece panel and the second doorway barrier piece bottom rail.

The system may further comprise a first bracket attachable to a first property wall adjacent to a left side of a door and/or a doorway frame, the first bracket comprising a back piece and a front L-shaped piece, wherein a back edge of the front L-shaped piece is joined or otherwise formed and attached to approximately a centerline of the back piece, wherein the back piece of the first bracket is divided into a first bracket exterior side and a first bracket interior side, wherein a plurality of holes are spaced in vertical alignment on a first portion of the back piece of the first bracket, wherein a first set of pegs in vertical alignment are spaced on a front side of a front post of the front L-shaped piece. Further, a second set of pegs are spaced in vertical alignment on a front side of the first bracket interior side, wherein a first bracket channel is formed in between the front side of the front post of the front L-shaped piece and the first bracket interior side, wherein the first bracket channel is configured to face towards the left side of the first doorway barrier piece. A second bracket attachable to a second property wall adjacent to a right side of the door and/or the doorway frame, the second bracket comprising a back piece and a front L-shaped piece, wherein a back edge of the front L-shaped piece is joined or otherwise formed and attached to approximately a centerline of the back piece, wherein the back piece of the first bracket is divided into a first bracket exterior side and a second bracket interior side, wherein a plurality of holes are spaced in vertical alignment on a first portion of the back piece of the second bracket, wherein a first set of pegs in vertical alignment are spaced on a front side of a front post of the front L-shaped piece, wherein a second set of pegs are spaced in vertical alignment on a front side of the second bracket interior side, and wherein a second bracket channel is formed in between the front side of the front post of the front L-shaped piece and the second bracket interior side, wherein the second bracket channel is configured to face towards the left side of the second doorway barrier piece.

The method may further include attaching the first bracket to the first property wall adjacent to the left side of the door and/or doorway frame, attaching the second bracket to the second property wall adjacent to the right side of the door and/or doorway frame, and sliding the first doorway barrier piece into the first bracket channel and into the second bracket channel. The method may further include, after sliding the first doorway barrier piece into the first bracket channel and into the second bracket channel, hooking the designated openings on a left side member of the first doorway barrier piece onto the second set of pegs of the first bracket and hooking the designated openings on a right side member of the first doorway barrier piece onto the second set of pegs of the second bracket. The method may further include stacking the set or plurality of beams into the first doorway barrier piece bottom rail channel of the first doorway barrier piece and attaching a second doorway barrier piece further comprising hooking the designated openings of the second doorway barrier piece for each side member of the second doorway barrier piece onto the first set of pegs of the first bracket and onto the first set of pegs for the second bracket, such that the second doorway barrier piece bottom rail of the second doorway barrier piece is facing a frontside of the first doorway barrier piece bottom rail. The method may further include testing the flood prevention system by pouring water into the second doorway barrier piece bottom channel of the second doorway barrier piece bottom rail to determine if any water goes past the first doorway barrier piece and past the set of beams. The method may further include keeping both the first doorway barrier piece with the set of beams positioned against the door and/or doorway as well as the second doorway barrier piece that is removably attached to the first doorway barrier piece, wherein the first doorway barrier piece extends past a width of the door and/or doorway. Upon completion of the use of the flood prevention system, the method may further include removing the set of beams and detaching the second doorway barrier piece from the first doorway barrier piece and removing the first doorway barrier piece, wherein the first bracket remains attached to the first property wall adjacent to a left side of the door and/or the doorway frame and the second bracket remains attached to the second property wall adjacent to the right side of the door and/or the doorway frame.

In one aspect, the set of beams are storable within the first doorway barrier piece bottom rail and/or within the second doorway barrier piece bottom rail upon completion of the use of the flood prevention system. In another aspect, the frontside of the second doorway barrier piece bottom rail hooks onto the frontside of the first doorway barrier piece bottom rail. In another aspect, when installed, a front surface of the second doorway barrier panel piece faces towards a front surface of the first doorway barrier panel piece. In another aspect, when installed, a rear surface of the second doorway barrier panel is visible from an external viewpoint and wherein the door and/the doorway are blockaded by both the first doorway barrier piece and the second doorway barrier piece and the set of beams. In another aspect, the first bracket and the second bracket are not attached to the door and/or the doorway when installed.

The present description includes description for a flood prevention system comprising a first doorway barrier piece having a first doorway barrier piece panel having a left side and a right side, the left side and right side comprising a first set of peg holes spaced apart from each other in a vertical orientation along the left side and the right side, and a base rail, wherein the base rail is attached or integrally formed with the first doorway barrier piece panel, and wherein the left side and the right side of the first doorway barrier piece panel extend past each terminal end of the base rail, wherein the base rail comprises a hollow channel and a front piece that extends laterally along a front side of the back surface, wherein the hollow channel is configured to receive a set of beams that are removably storable within the hollow channel of the base rail of the first doorway barrier piece.

The flood prevention system may further include a second doorway barrier piece comprising a second doorway barrier piece panel, a second doorway barrier piece left side member, a second doorway barrier piece right side member, and a second doorway barrier piece bottom rail, wherein the second doorway barrier panel left side member, the second doorway barrier piece right side member, and the second doorway barrier piece bottom rail are positioned in front of the second doorway barrier piece panel such that a channel is present between the second doorway piece left side member, the second doorway piece right side member, and the second doorway barrier piece bottom rail and the second doorway barrier piece back surface. Further, a set of second doorway barrier piece peg holes included on the second doorway barrier piece left side member and on the second doorway barrier piece right side member. Further, a set of second doorway barrier pegs are distributed in horizontal alignment on a front surface of the second doorway barrier piece bottom rail. The system may further include a first bracket attachable to a first property wall adjacent to a left side of a door and/or a doorway frame, the first bracket comprising a back piece, a front L-shaped piece, wherein a back edge of the front L-shaped piece is joined or otherwise formed and attached to approximately a centerline of the back piece, wherein the back piece of the first bracket is divided into a first bracket exterior side and a first bracket interior side, and wherein a plurality of holes are spaced in vertical alignment on a first portion of the back piece of the first bracket. Further, the first set of pegs in vertical alignment are spaced on a front side of a front post of the front L-shaped piece, wherein a second set of pegs are spaced in vertical alignment on a front side of the first bracket interior side, wherein a first bracket channel is formed in between the front side of the front post of the front L-shaped piece and the first bracket interior side, wherein the first bracket channel is configured to face towards the left side of the first doorway barrier piece. The second bracket is similar in appearance and form to the first bracket.

In another aspect, the first bracket and the second bracket and the first doorway barrier piece and the second doorway barrier piece are not attachable to the door or to the doorway frame. In another aspect, the first doorway barrier piece panel hooks onto the first bracket and onto the second bracket. In another aspect, the first set of peg holes on the left side of the first doorway barrier piece panel hook onto the second set of pegs on the front side of the first bracket interior side of the first bracket and wherein the first set of peg holes on the right side of the first doorway barrier piece panel hook onto the front side of the second bracket interior side of the second bracket. In another aspect, the set of second doorway barrier piece peg holes on the second doorway barrier piece left side member hook onto the first set of pegs on the front side of the front post of the front L-shaped piece of the first bracket and wherein the set of second doorway barrier piece peg holes on the second doorway barrier piece right side member hook onto the first set of pegs on the front side of the front post of the front L-shaped piece of the second bracket. In another aspect, the set of second doorway barrier pegs on the front surface of the second doorway barrier piece bottom rail hook into the set of peg holes in horizontal alignment on the front piece of the base rail of the first doorway barrier piece.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present disclosure is generally drawn to various embodiments for a flood prevention system that is particularly suitable for preventing flooding of doors and doorways of homes and businesses or any other physical location.

Figure 1:
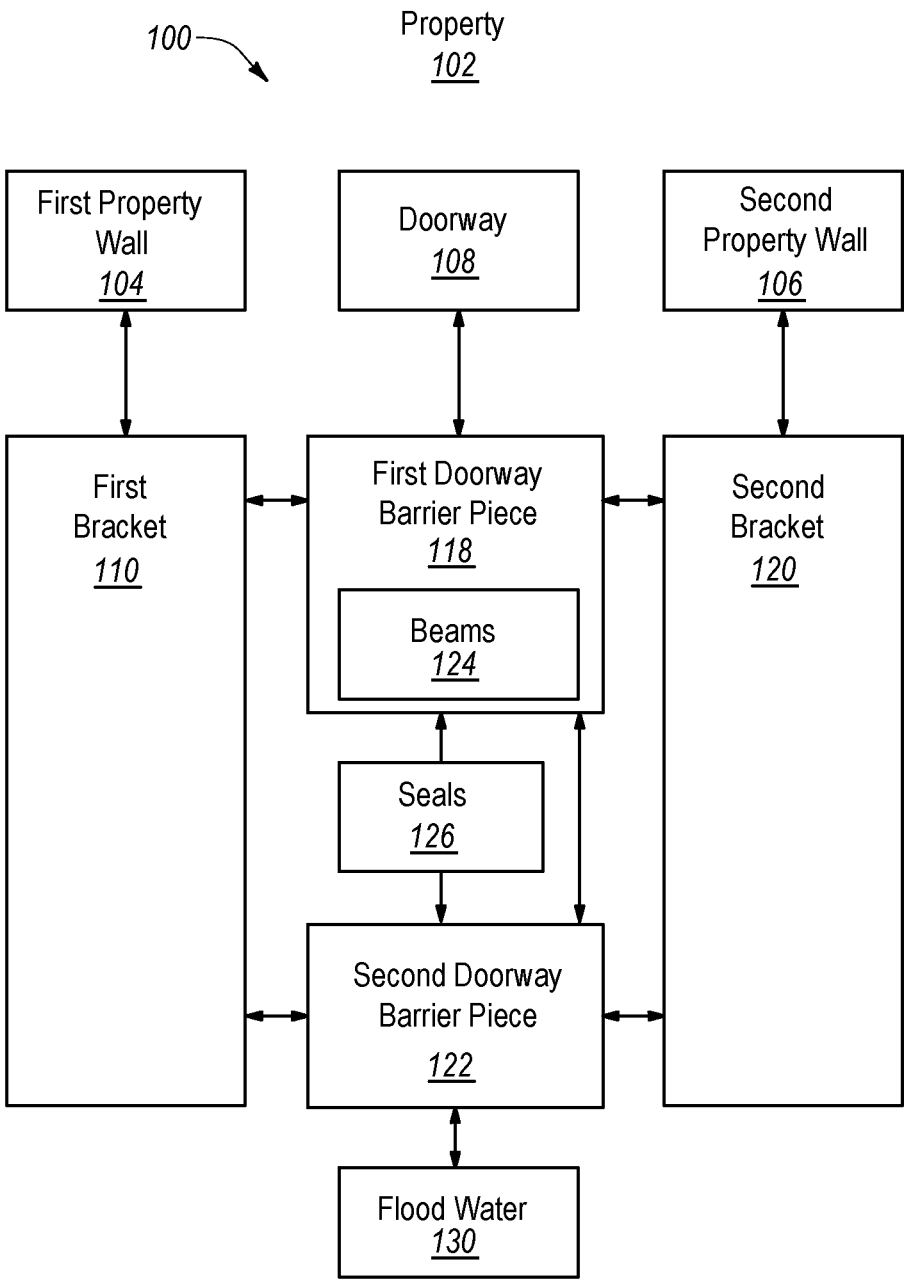
FIG. 1 is a block diagram of a flood prevention system.

FIG. 1 illustrates a non-limiting embodiment of the flood prevention system 100 which incorporates a number of components as shown in FIG. 1 and throughout FIGS. 2-11. In a non-limiting embodiment, the flood prevention system 100 includes a first bracket 110, a second bracket 120, a first doorway barrier piece 118, a second doorway barrier piece 122, and seals 126 affixed or attached to the first doorway barrier piece 118 and the second doorway barrier piece 122. The flood prevention system 100 may be installed on a property 102. The property 102 may include, but is not limited to, residential structures including homes, apartments, condos, beach houses, mobile homes, trailers, or any other type of structure used as a residence. The property 102 may also be a non-residential, business location or structure, including, but not limited to, offices, store fronts, and buildings. It is intended that the flood prevention system 100 may act as a barrier and prevention system that is easily installable and removable by users to minimize flood damage due to any flood water 130. The flood water 130 may be a result from flooding due to storms, hurricanes, tornadoes, or may be due to other causes of flooding without limitation thereto.

In a non-limiting embodiment, the first bracket 110 may be fastened and/or otherwise attached to a first property wall 104 adjacent to a doorway 108. The second bracket 120 may be fastenably attached and/or otherwise attached to the second property wall 106 adjacent to the doorway 108. The first property wall 104 may be the wall portion of the property 102 to the left of the doorway 108 and the second property wall 106 may be the wall portion of the property 102 to the right of the doorway 108.

The first doorway barrier piece 118 is removably attached to the first bracket 110 and the second bracket 120. The second doorway barrier piece 122 is also removably attached to the first bracket 110 and the second bracket 120. The second doorway barrier piece 122, as shown in an example in FIG. 2 and FIG. 3, is turned to face inward toward the doorway 108 while the first doorway barrier piece 122 faces away from the doorway 108.

In a non-limiting embodiment, a set of beams 124 are stacked either vertically or horizontally into the specific design of the first doorway barrier piece 118. The beams 124 may be solid and/or hollow in one or more non-limiting embodiments. The beams 124 act as another physical barrier to minimize or prevent flood water 130 from passing through the doorway 108 of a property. The flood water 130 should also be prevented from passing through the doorway 108 and into the property 102 due to the presence of the second doorway barrier piece 122 as well. In a non-limiting embodiment, any flood water 130 attempting to pass through the flood prevention system 100 should be prevented by the overall combination of components described in FIG. 1 and shown elsewhere in FIGS. 2-11 and further described below.

Figure 2:
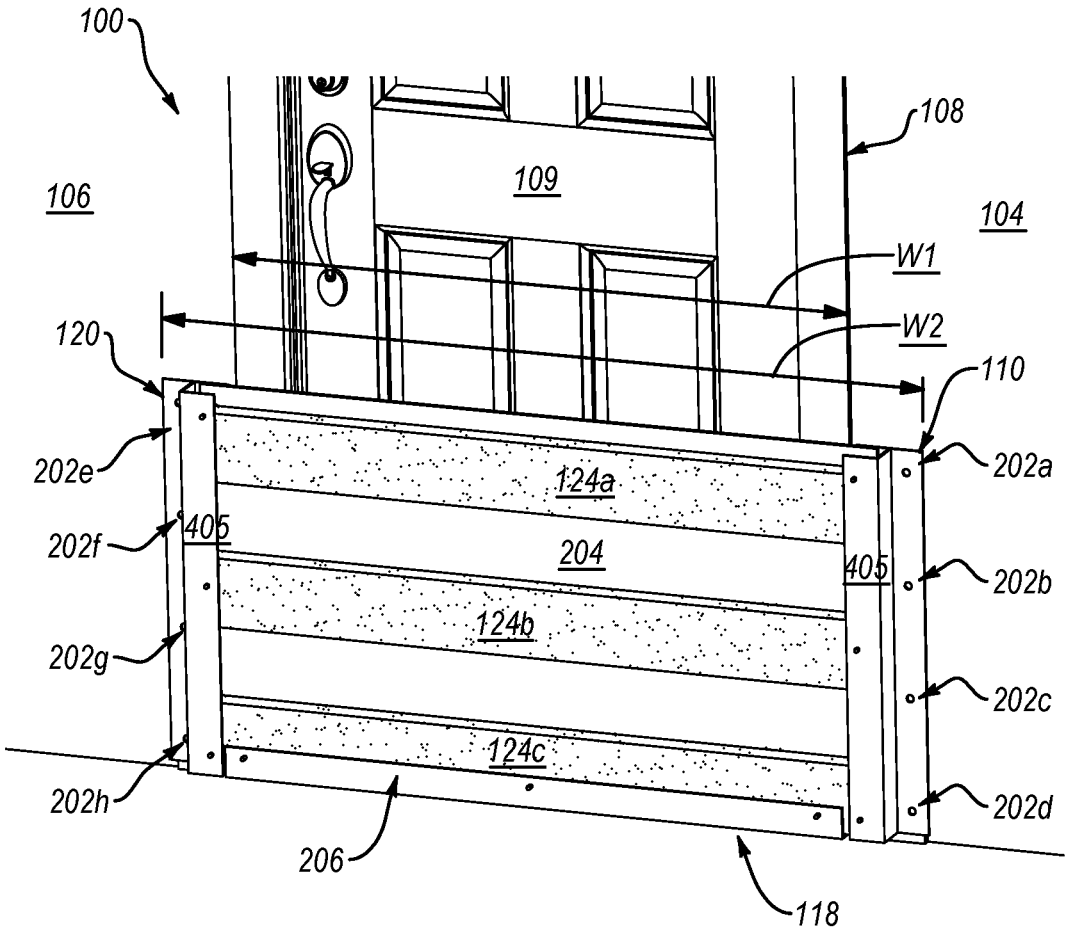
FIG. 2 is a pictorial illustration of a doorway barricaded by the first doorway barrier piece and a set of beams with a first bracket and a second bracket on either side of the doorway.
Figure 3:
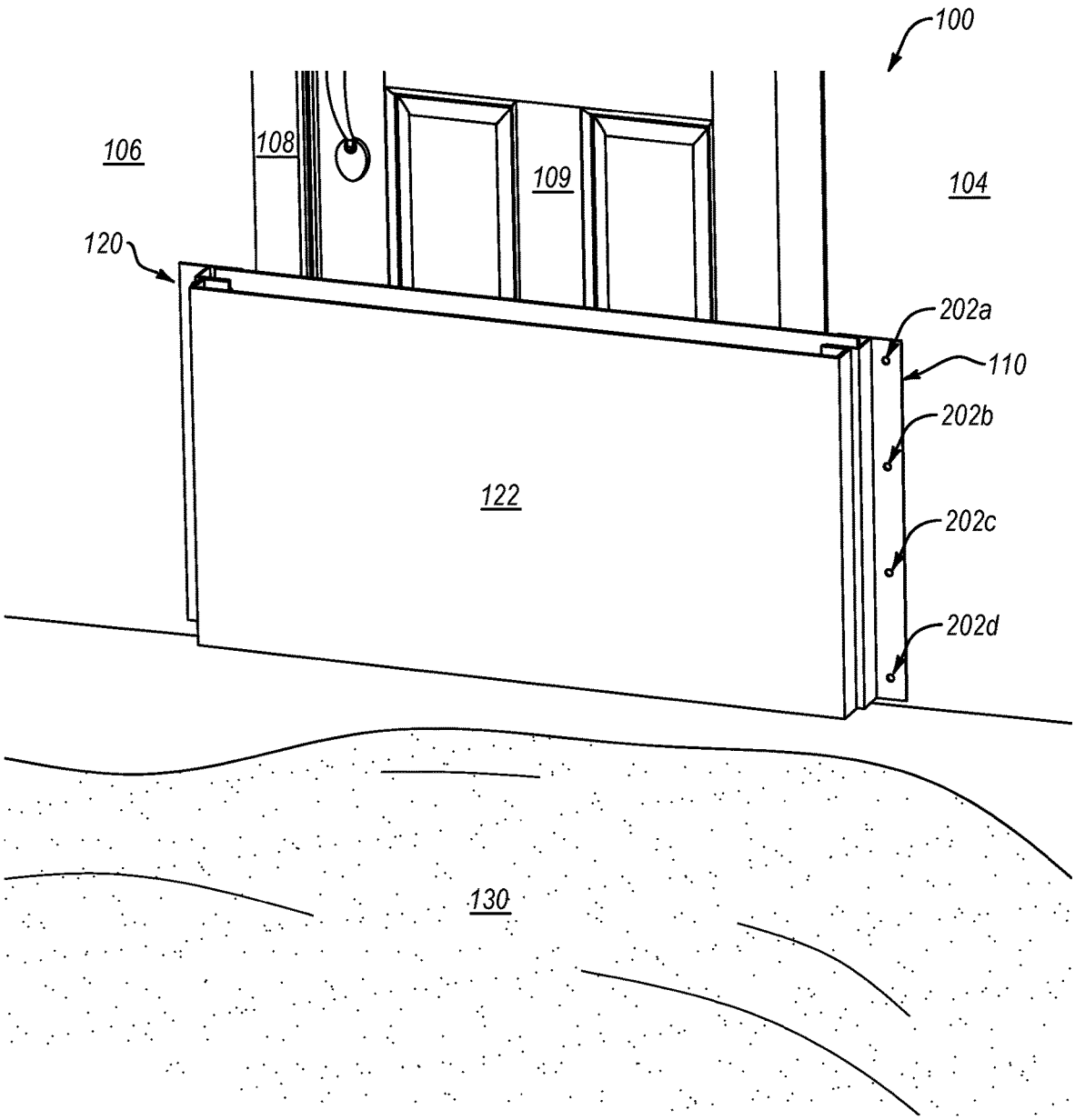
FIG. 3 is a pictorial illustration of the second doorway barrier piece covering the first doorway barrier piece.

FIG. 2 and FIG. 3 show exemplary pictorial illustrations of the flood prevention system 100 as installed in front of the doorway 108 and on a property 102. FIG. 2 shows that the first bracket 110 is attached to the first property wall 104 that is adjacent to the left side of the doorway 108. FIG. 2 further shows that the second bracket 120 is attached to the second property wall 106 that is adjacent to the right side of the doorway 108. In a non-limiting embodiment, the doorway 108 may encompass the doorframe and the door 109. Advantageously, the flood prevention system 100 is designed so that the components are not fastened or attached to the door 109, thereby avoiding damaging or making unsightly holes or other damage to the door 109 itself.

In a non-limiting embodiment, fasteners (e.g., removable screws, nails, other types of fasteners) may be inserted through the fastener holes 202*a*, 202*b*, 202*c*, 202*d* on the first bracket 110 and the fastener holes 202*e*, 202*f*, 202*g*, 202*h* included with the second bracket 120 in order to fasten the first bracket 110 to the first property wall 104 by a lower half of the doorway 108 and in order to fasten the second bracket 120 to the second property wall 106 by a lower half of the doorway 108.

Figure 4A:
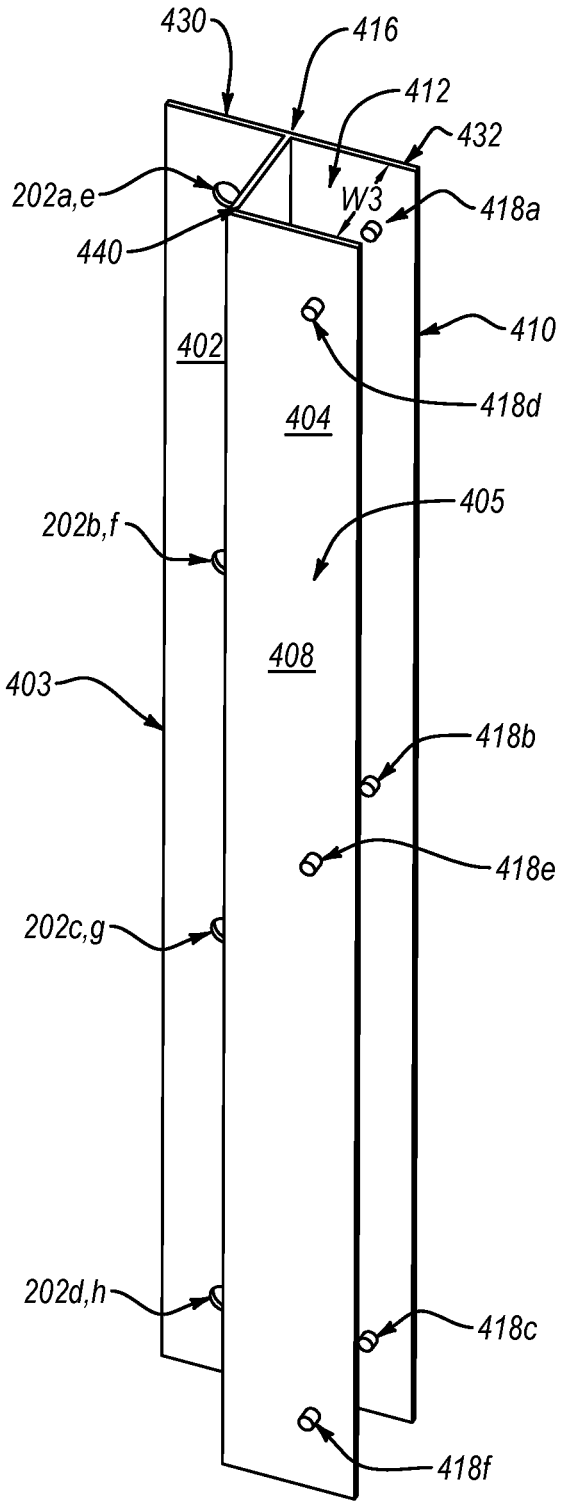
FIG. 4A is a front perspective view of the first and second bracket.
Figure 4B:
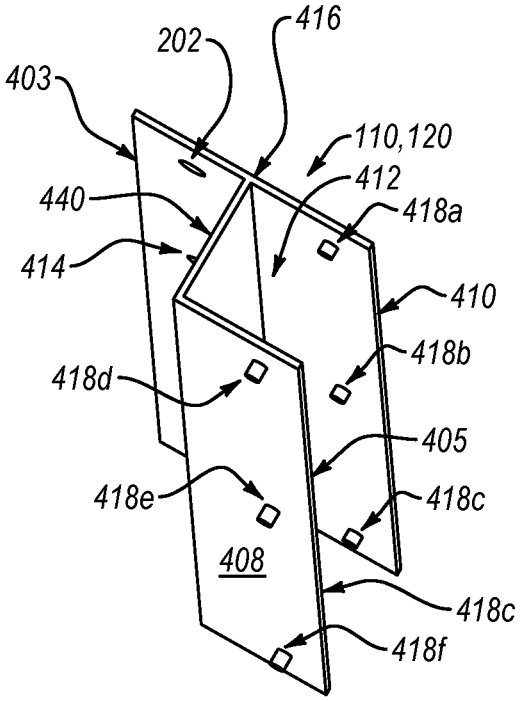
FIG. 4B is a top perspective view of the first and second bracket.
Figure 5:
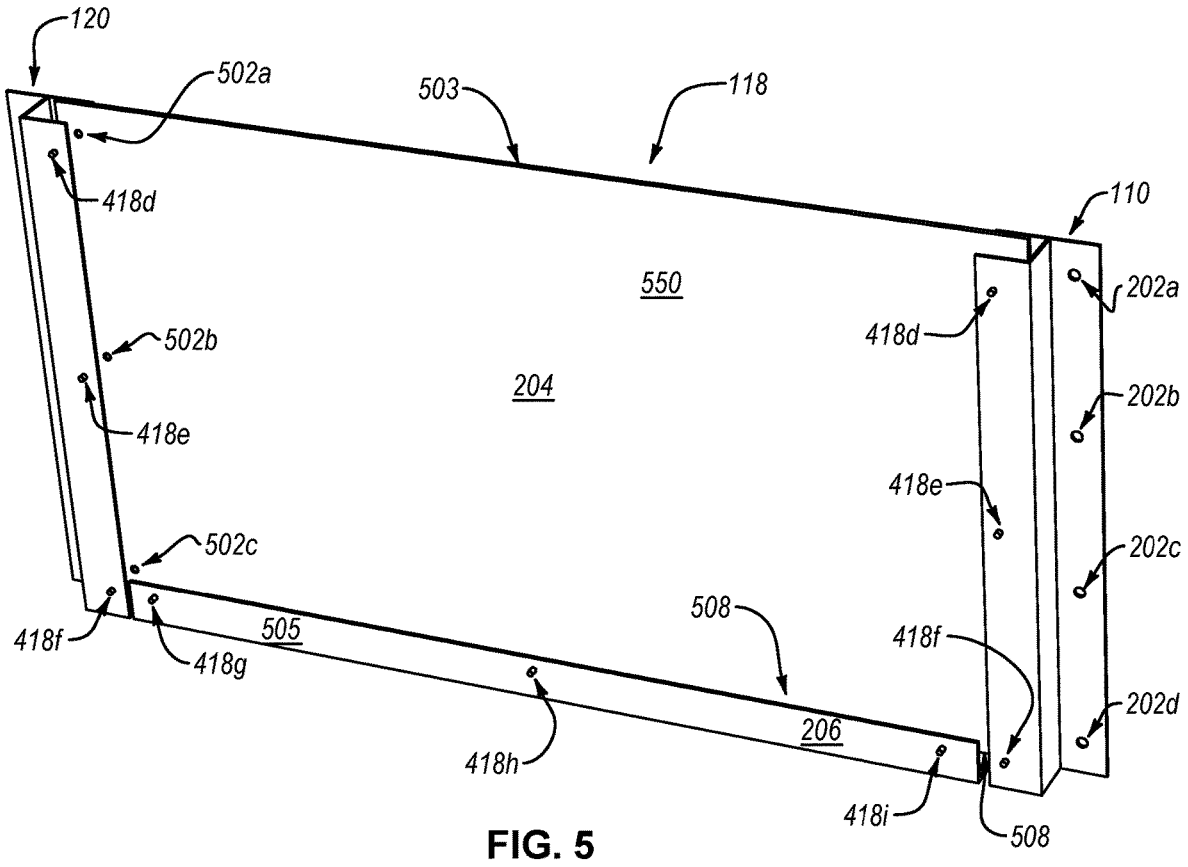
FIG. 5 is a pictorial illustration of the front side of the first doorway barrier piece coupled to the first and second bracket.

As shown in FIG. 2, the first doorway barrier piece 118 is removably attached and/or slid into place in between the first bracket 110 and the second bracket 120. The first doorway barrier piece 118 includes, in a non-limiting embodiment, a panel 204 and a bottom rail 206 (of which further detail may be provided below). Further, as shown in FIG. 5, there is a hollow channel 508 extending through the bottom rail 206 of the first doorway barrier piece 118 which is capable of receiving the stacked beams 124 (e.g., 124*a*-124*c*) in the channel 508. The beams 124 may be stacked horizontally one over the other as shown and will further be retained by the side support members of the first bracket 110 and the second bracket 120 (e.g., side support members 408 and 410 as shown in FIGS. 4A-4B). A set of exemplary beams 124*a*, 124*b*, 124*c* are shown stacked in a horizontal manner in FIG. 2 but the set of beams 124 may also be stacked vertically one against another if the user so desires. The set of beams 124 may be wooden or metal 2×4 beams in one or more non-limiting embodiments. It is noted that even though FIG. 2 shows gaps between the beams 124*a*, 124*b*, and 124*c*, this is not required in use. The beams 124*a*-124*c* and other beams 124 may be stacked one on top of the other so that there are no gaps between each beam 124.

In a non-limiting embodiment, the width W1 as shown in FIG. 2 spans from a first edge of the first bracket 110 as attached to the first property wall 104 and a first edge of the second bracket 120 as attached to the second property wall 106. Notably, width W1 is wider than the width W2 of the door 109 itself, which is purposeful, so that the flood doorway prevention system 100 can act as a barrier to the flood water 130 (e.g., as shown in FIG. 3) to prevent the flood water 130 from flooding into the property 102 past the door 109 and causing expensive damage to the property 102 itself. Notably, the first doorway barrier piece 118 extends wider than the doorway 108 so as to prevent flood water 130 from seeping past the cracks and openings of the door 109 which has a narrower width W2.

Figure 7:
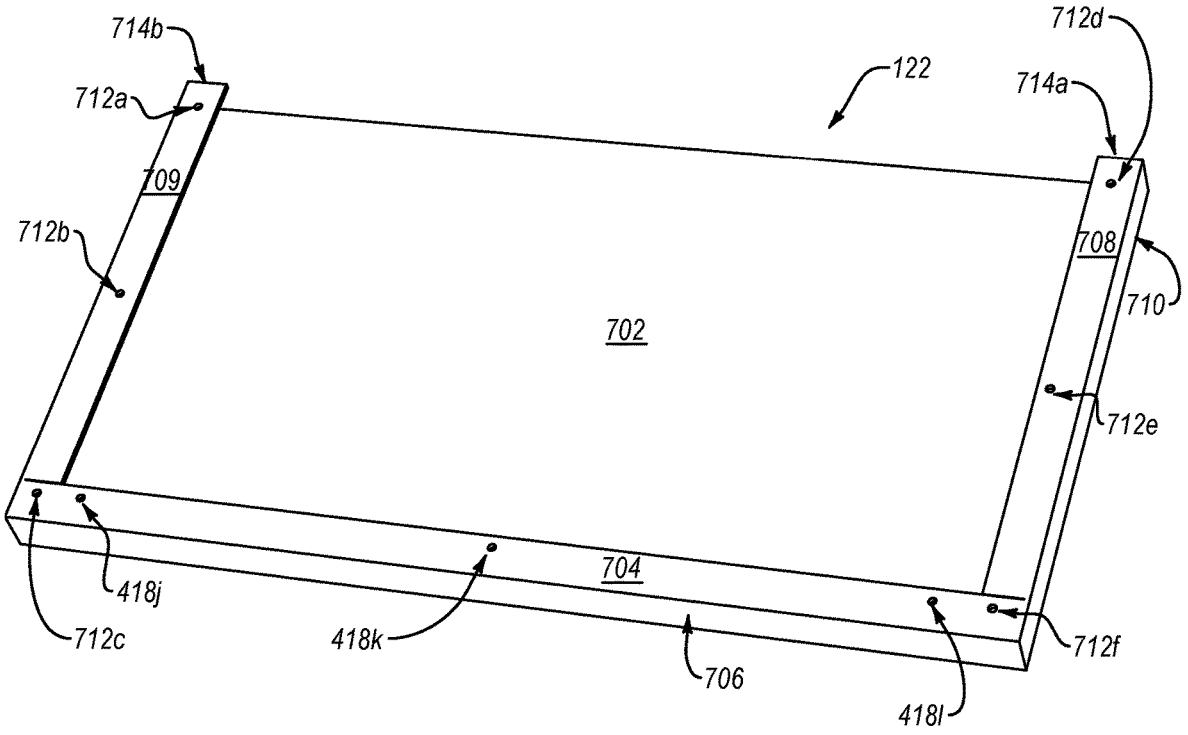
FIG. 7 is a pictorial illustration of a bottom perspective view of the second doorway barrier piece.

FIG. 3 shows that the second doorway barrier piece 122 is further connected to the first bracket 110 and the second bracket 120 and installed facing the first doorway barrier piece 118. The second doorway barrier piece 122 has a number of functions, as further explained below, including serving as a second reinforcement structural piece to prevent damage to the door 109 from the encroaching flood water 130 and further may be used as a test case to test the efficacy of the first doorway barrier piece 118 because the user can pour water into the hollow channel 714*c* of the bottom rail 704 (e.g., as shown in FIG. 7 and in FIG. 8) and observe if the test water has passed through the beams 124 and the first doorway barrier piece 118 as removably connected to the first bracket 110 and the second bracket 120 past the doorway 108 into the property 102 or not. Further, if so desired, the user can stack one or more additional beams 124 into the bottom rail 704 (e.g., as shown in FIG. 7) of the second doorway barrier piece 122. Thus, the second doorway barrier piece 122 may have a number of functions and roles.

FIGS. 4A and 4B provide a closer, in-depth view of the first bracket 110 and the second bracket 120. In a non-limiting embodiment, the first bracket 110 and the second bracket 120 are identical in appearance, except that the first bracket 110 is oriented so that the front L-shaped piece 405 of the first bracket 110 is oriented facing to the left or towards the front L-shaped piece 405 of the second bracket 120. This is such that the first doorway barrier piece 118 can be inserted in between the first bracket 110 and the second bracket 120 on the left and right side, respectively, of the doorway 108 with the front L-shaped portion 405 of the brackets 110, 120 facing each other as shown in FIG. 2.

FIG. 4A and FIG. 4B show that the brackets 110, 120 are identical in appearance. As noted above, the only difference is that one bracket (e.g., bracket 110 as shown in FIG. 2A and FIG. 2B) is oriented to face towards the left side direction and another bracket (e.g., bracket 120 as shown in FIG. 2A and FIG. 2B) is shown facing the right side direction. In terms of structure, the first bracket 110 and the second bracket 120 is comprised of a back piece 403 that connects to the front L-shaped piece 405.

The front L-shaped piece 405 may be comprised of a side piece 440 and a front piece 408 that joins together to form an L. The back piece 403 of the brackets 110, 120 includes the exterior portion 430 (exterior to the front L-shaped piece 405) and the interior portion 432 as shown in FIG. 4A. A hollow channel 412 extends vertically down between the front piece 408 and the interior back portion 432 of the back piece 403.

Along the inside of the interior portion 432 of the brackets 110, 120, are several pegs or hooks 418*a*, 418*b*, 418*c* as shown in FIGS. 4A-4B. The pegs or hooks 418 throughout are useful for one component of the flood prevention system 100, such as the first doorway barrier piece 118 and the second doorway barrier piece 122, to removably connect to the first bracket 110 and to the second bracket 122. The pegs or hooks 418 are shown in FIGS. 4A-4B to be protruding elements. The pegs or hooks 418 (or guides) also have a cylindrical shape. It is noted that this is an exemplary embodiment as other variations in design for the pegs or hooks 418 may alternatively or additionally be used.

Along a front side 404 of the front piece 408 of the brackets 110, 120 are additional pegs or hooks 418*d*, 418*e*, and 418*f* as shown in FIGS. 4A-4B. These pegs 418*d*, 418*e*, and 418*f* are a second set of pegs or hooks that are intended to be used to couple the second doorway barrier piece 122 to the pegs or hooks 418*d*, 418*e*, and 418*f* of the brackets 110, 120. The first set of interior positioned pegs or hooks 418*a*, 418*b*, and 418*c* are dedicated to coupling to the first doorway barrier piece 118, as shown for example in FIG. 2 and in FIG. 5.

Along the exterior portion side 430 of each bracket 110, 120 are located several fastener holes 202*a,e*, 202*b,f*, 202*c,g*, as shown in FIGS. 4A-4B. As noted above with respect to FIGS. 2-3, these fastener holes 202*a*-202*g* are intended to receive fasteners (e.g., screws) to fastenably attach the exterior portion side 430 of each bracket 110, 120 adjacent to the left side and the right side of the doorway 108 on the first property wall 104 and the second property wall 106.

Figure 6:
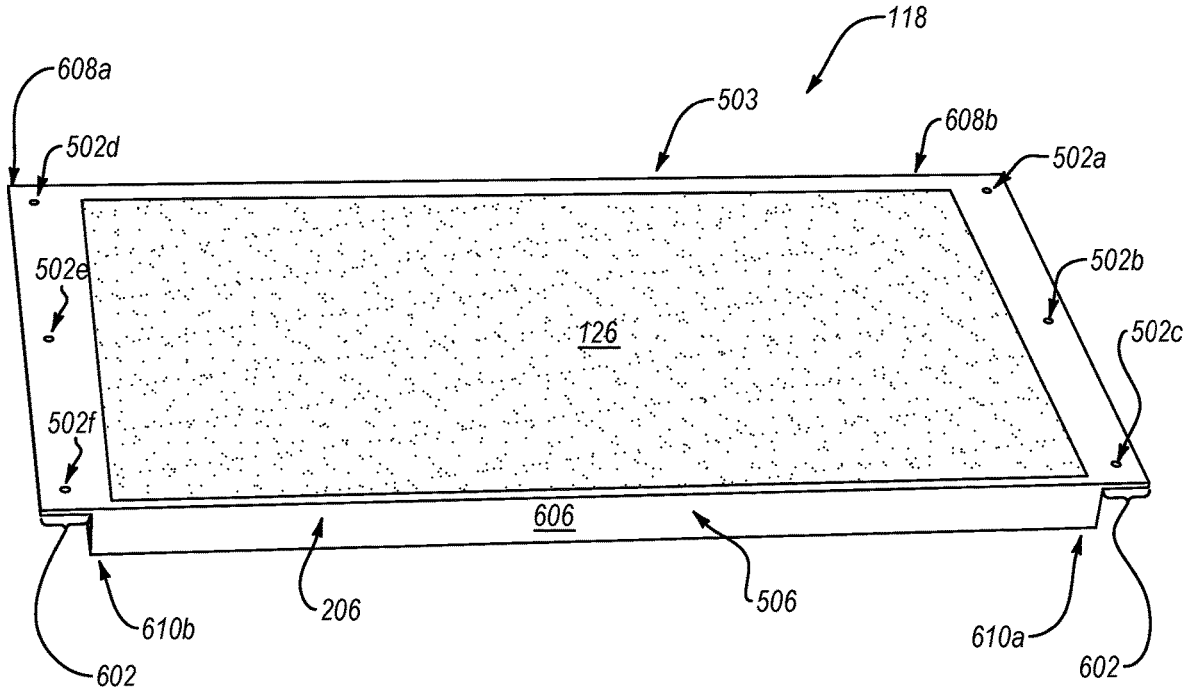
FIG. 6 is a pictorial illustration of the rear side of the first doorway barrier piece.

The width W3 of the hollow channel 412 is at least as wide as the width of the first doorway barrier piece 118 which is intended to fit within the hollow channel 412 when in use. Preferably, the hollow channel 412 is a little wider than the width of the first doorway barrier piece 118 to accommodate clearance fit whereby the first doorway barrier piece 118 should be able to be guided in and out without obstruction, and where alignment can be loosely guided but does not require tight precision such that the holes 502*a*, 502*b*, 502*c*, 502*d*, 502*e*, and 502*f* of the first doorway barrier piece 118 (e.g., as shown in FIG. 5 and FIG. 6) can easily connect to the hooks or pegs 418*a*,418*b*, 418*c* on the interior back piece 432 of the back piece 403 of the brackets 110, 120.

It is noted that in an alternative embodiment, rather than having pegs or hooks 418, and in place of the brackets, there may be holes dedicated to receiving fasteners (e.g., screws) to screw the first doorway barrier piece 118 and/or second doorway barrier piece 122 into place. Alternatively, hook and loop fasteners, such as VELCRO, may be used to removably couple the first doorway barrier piece 118 and the second doorway barrier piece 122 to the brackets 110, 120 in their designated locations.

FIG. 5 shows the combination of the first and second brackets 110, 120 with the first doorway barrier piece 118 positioned coupled to the first and second brackets 110, 120. FIG. 6 shows a rear view of the first doorway barrier piece 118 without the first and second brackets 110, 120 so that it is easier to see and understand the potential structure and design of the first doorway barrier piece 118.

FIG. 5 illustrates a front side 550 of the first doorway barrier piece 118. As shown in FIG. 5 and as noted above, there is a front panel piece 204 that makes up the majority of the first doorway barrier piece 118. The front panel piece 204 is generally rectangular in shape and should be a solid, somewhat thick panel. The front panel piece 204, when in use, will be positioned up against the door 109 of the doorway 108 of a property 102 as shown in FIG. 2. The first doorway barrier piece 118 further includes a bottom rail 206 that has a channel 508 extending therethrough. The bottom rail 206 or lip is configured to receive the beams 124 as shown in FIG. 2, whereby in a non-limiting embodiment the beams 124 may be one or more 2×4 wooden beams (or beams of any other material type). On a front side 505 of the bottom rail 206, are one or more hooks, pegs, or guides 418*g*, 418*h*, 418*i* as shown in FIG. 5. The top edge 503 of the first doorway barrier piece 118, in a non-limiting embodiment, does not extend above the top edges of the brackets 110, 120. Alternatively, in other non-limiting embodiments, the top edge 503 of the first doorway barrier piece 118 (and/or the second doorway barrier piece 122) may extend above the top edges of the brackets 110, 120.

FIG. 6 shows the rear view of an exemplary first doorway barrier piece 118. The first doorway barrier piece 118 shows that there is an exemplary seal 126 that may cover the back portion of the panel 204 of the first doorway barrier piece 118. Notably, the seals 126 may be located also on the bottom side 606 (e.g., as shown in FIG. 6) of the bottom rail 206 in one or more non-limiting embodiment as well as along the sides and/or on the front side of the panel 204. The seals 126 may be located on every component of the flood prevention system 100 including anywhere water may seep in.

As shown in FIG. 6, there are three fastener holes 502*d*, 502*e*, 502*f* on a left side portion of the panel 204 of the first doorway barrier piece 118 and three fastener holes 502*a*, 502*b*, and 502*c* on the right side portion of the first doorway barrier piece 118 as shown in FIG. 6. The left side portion 608*a* and right side portion 608*b* extend slightly wider as shown at 602 in FIG. 6 and in FIG. 10 than the bottom rail 206 of the first doorway barrier piece 118. Accordingly, the left side portion 608*a* of the first doorway barrier piece 118 comprises a set of fastener holes 502*d*, 502*e*, 502*f* that can be hooked or otherwise positioned over the pegs 418*a*, 418*b*, 418*c* located on the interior portion 432 of the first bracket 110 (e.g., as shown in FIG. 4A). Similarly, the right side 608*b* of the first doorway barrier piece 118 comprises another set of fastener holes 502*a*, 502*b*, and 502*c* that can be hooked or otherwise positioned over the pegs 418*a*, 418*b*, and 418*c* of the second bracket 120 in one or more non-limiting embodiments.

Figure 8:
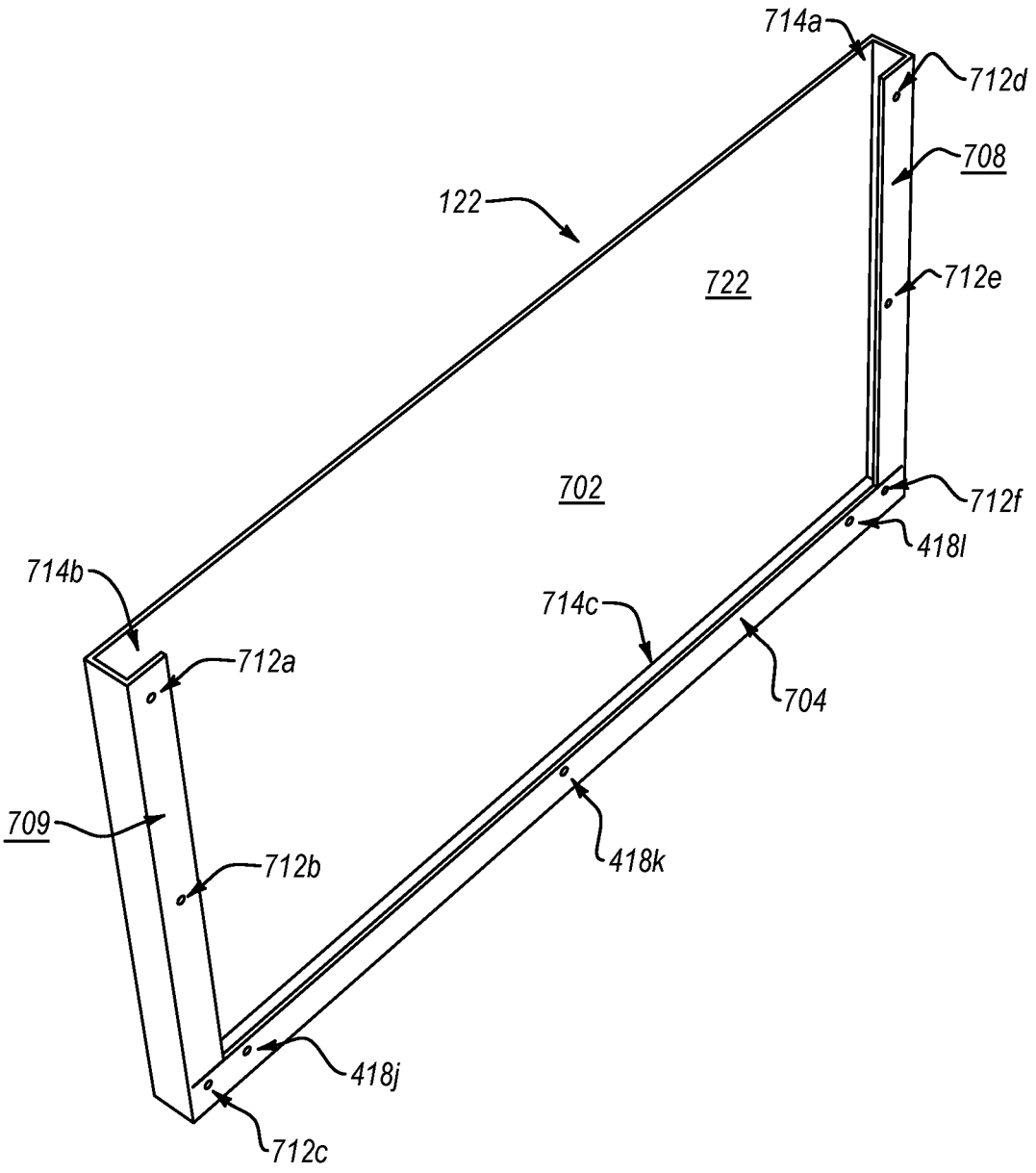
FIG. 8 is a top perspective view of the second doorway barrier piece.

FIG. 7 and FIG. 8 illustrate the second doorway barrier piece 122 according to one or more non-limiting embodiments. FIG. 8 provides a front perspective view of the second doorway barrier piece 122. As shown in FIG. 7 and in FIG. 8, there may be a wider elongated single panel 702 that is coupled to a bottom rail 704. Further, there may be a first side support beam 708 and a second side support beam 709 on the second doorway barrier piece 122. There may be a hollow channel 714*a*, as shown in FIG. 7, extending between the panel 702 and the first side support beam 708 as well as a hollow channel 714*b* extending between the panel 702 and the second side support beam 709. FIG. 8 shows a third hollow channel 714*c* extending between the panel 702 and the interior side of the bottom rail 704 of the second doorway barrier piece 122. As shown in FIG. 7, there may be a set of dedicated peg holes 712*d*, 712*e*, and 712*f* in vertical alignment positioned on the first side support beam 708 as well as a set of peg holes 712*a*, 712*b*, and 712*c* on the second side support beam 709. A set of peg holes 418*j*, 418*k*, and 418*l* are also integrated or included on the front side or front lip of the bottom rail 704 as shown in FIG. 7. In a non-limiting embodiment, the bottom rail 704 of the second doorway barrier piece 122 connects to the side members 708, 709 of the second doorway barrier piece 122 and there is not a gap between the bottom rail 704 on the sides (as is the case with the first doorway barrier piece 118). As further explained and shown below, the front side 722 of the second doorway barrier piece 122 is intended to face the front side 550 of the first doorway barrier piece 118 when installed in use in front of the doorway 108 to prevent flood water 130 from penetrating through the flood prevention system 100 into the doorway 108 and the property 102.

Figure 9:
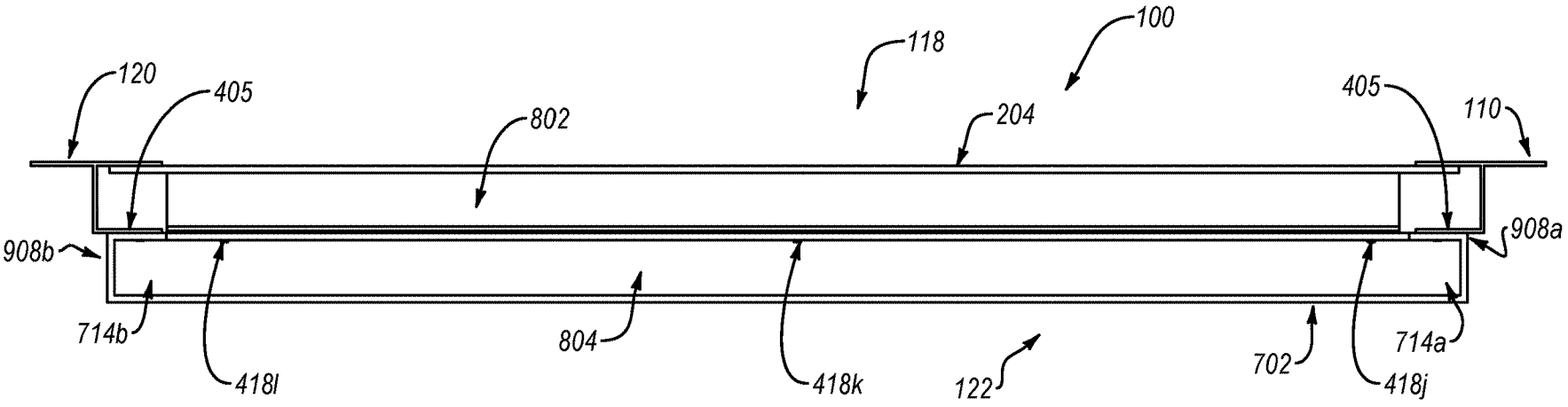
FIG. 9 is a top view of the flood prevention system and the components coupled together.
Figure 10:
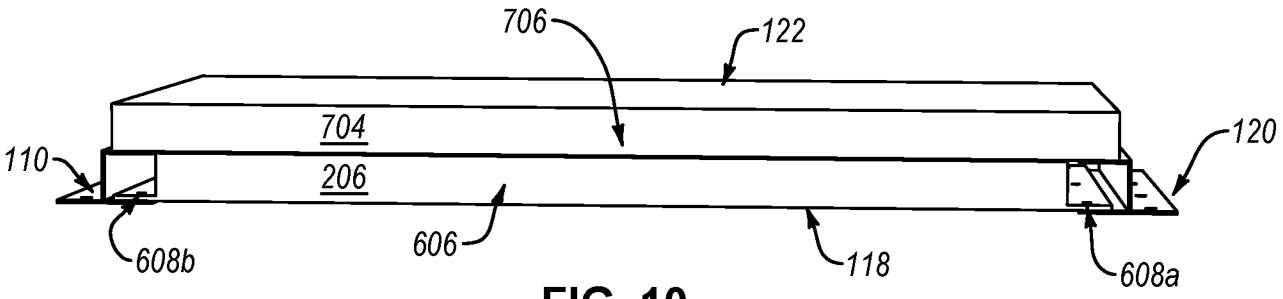
FIG. 10 is a bottom view of the flood prevention system and the components coupled together.

FIG. 9 shows a top view of the flood prevention system 100 with some components coupled together. FIG. 10 show a bottom view of the flood prevention system 100 with some components coupled together. For example, the first doorway barrier piece 118 is shown coupled to the first bracket 110 and the side bracket 120. Further, the second doorway barrier piece 122 is coupled to the first bracket 110 and the side bracket 120 and is further coupled to the to the first doorway barrier piece 118, because the pegs/hooks 418*g*, 418*h*, and 418*i* on the front side 505 of the bottom rail 206 (e.g., as shown in FIG. 5) of the first doorway barrier piece 118 removably insert into or hook into the holes 418*j*, 418*k* and 418*l* on the frontside of the bottom rail 704 of the second doorway barrier piece 122. Accordingly, the user may pick up the second doorway barrier piece 122 and turn so that the front side 722 (e.g., as shown in FIG. 8) of the panel 702 of the doorway barrier piece 122 faces the front side 550 of the panel of the first doorway barrier piece 118. Next, the user may hook the peg holes 712*a*, 712*b*, 712*c* on side member 709 of the second doorway barrier piece 122 onto the pegs/guides 418*d*, 418*e*, 418*f* that extend in vertical alignment on a front side 404 of the first bracket 110. Similarly, the user may hook the peg holes 712*d*, 712*e*, and 712*f* on side member 708 of the second doorway barrier piece 122 onto the pegs/guides 418*d*, 418*e*, and 418*f* on the front side 404 of the second bracket 110. In this manner, the second doorway barrier piece 122 is removably coupled to the first doorway barrier piece 118 by virtue of the bottom rail 704 of the second doorway barrier piece 122 hooking onto the bottom rail 206 of the first doorway barrier piece 118. Further, the second doorway barrier piece 122 is removably coupled to the first bracket 110 and the second bracket 122 by virtue of the hooking onto the pegs 418*d*, 418*e*, 418*f* on the front side 404 of the first bracket 110 and the second bracket 122. At 908*a* and 908*b*, FIG. 9 shows how the second doorway barrier piece 122 is coupled to a front side (i.e., 405 as shown in FIG. 4A and FIG. 4B) of the first bracket 110 and the second bracket 120.

As shown in FIG. 9, a cavity 802 is formed between panel 204 of the first barrier piece 118 and the bottom rail 206 of the first doorway barrier piece 118 and a second cavity 804 is formed between the panel 702 and the bottom rail 704 of the second doorway barrier piece 122. As noted above, beams 124 may be stacked in place in the cavity 802 of the first doorway barrier piece 118. Alternatively, or additionally, additional beams 124 may be stacked in place in the cavity 804 of the second doorway barrier piece 122 to help further prevent flood water 130 from penetrating through the doorway 108 of the property 102. Additionally, a user may pour water up to the top edge of the panel 702 of the second doorway barrier piece 122 (or to a lower point) to test and see if any of that water enters the property 102 prior to any flood water 130 actually occurring in order to test the flood prevention system 102 to see if the water is barred by the first doorway barrier piece 118 with the stacked set of beams 124 and/or seals 126 incorporated onto the first doorway barrier piece 118 from entering through the cracks and openings of the doorway 108 of the property 102.

FIG. 10 shows a bottom view of the flood prevention system 100. The bottom side 706 of the second doorway barrier piece 122 and the bottom side 606 of the first doorway barrier piece 118 are intended to be positioned flat and evenly on the ground surface in front of the doorway 108 of the property to prevent water 130 from flowing under the first doorway barrier piece 118 and the second doorway barrier piece 122. The bottom surface 706 of the bottom rail 704 of the second doorway barrier piece 122 is also the bottom of the second doorway barrier piece 122. Conversely, the bottom surface 606 of the bottom rail 206 of the first doorway barrier piece 118 is also the bottom of the first doorway barrier piece 118. Using the beams 124 that are stacked into the bottom rail 206 of the first doorway barrier piece 118 and the bottom rail 704 of the second doorway barrier piece 122 helps to keep the bottom surfaces flat against the ground surface of the property 102 in front of the doorway 108 as well. Further, there may be one or more seals 126 as shown in an example in FIG. 6 all around the edges of the first doorway barrier piece 118, the second doorway barrier piece 122, and/or the first bracket 110 and second bracket 122 to help prevent flood water 130 from entering into the property 102 via any doorway 108 openings.

Figure 11:
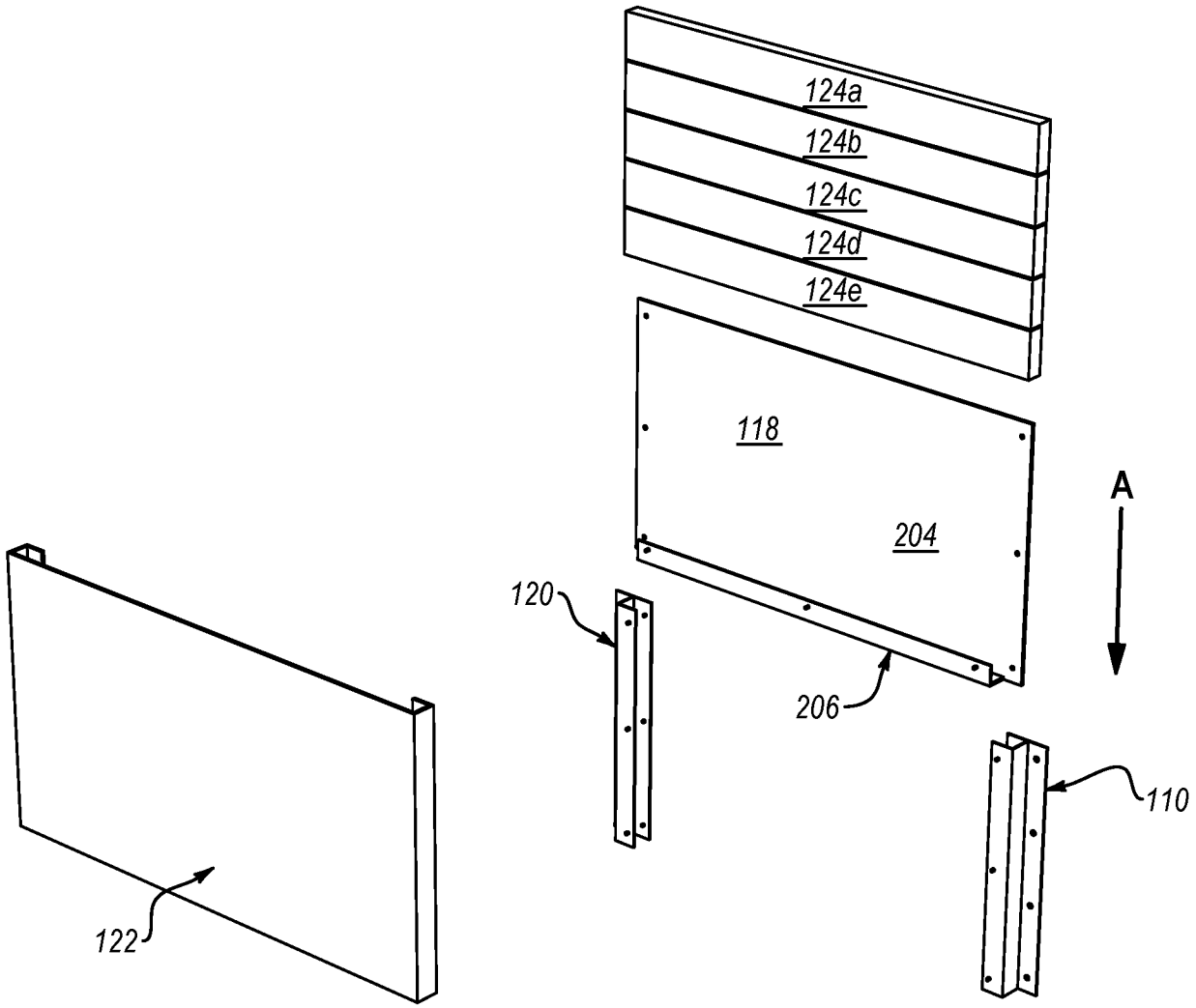
FIG. 11 is an exploded view of the first bracket, the second bracket, the set of beams, and the first doorway barrier piece and the second doorway barrier piece.

FIG. 11 is a pictorial illustration illustrating that the first doorway barrier piece 118 is removable. It may be inserted into the first bracket 110 and second bracket 120 in the direction of arrow A if needed. But, when the user no longer needs the first doorway barrier piece 118 to be in place ahead of the doorway 108, the user can remove the first doorway barrier piece 118 by unhooking the sides 608*a*, 608*b* of the first doorway barrier piece 118 from the interior position pegs 418*a*, 418*b*, and 418*c* of the brackets 110, 120. The user may keep the first bracket 110 and the second bracket 120 fastened to the first property wall 104 and the second property wall 106 of the property 102 for ease of subsequent use. The set of beams 124 can be stored inside of the cavity 802 of the first doorway barrier piece 118. Further, in a non-limiting embodiment, the second doorway barrier piece 122 can also slide into and fit within the cavity 802 of the first doorway barrier piece 118, and then the user can stack the set of beams 124 within the cavity 804 of the second doorway barrier piece 122 for easy storage.

Figure 12:
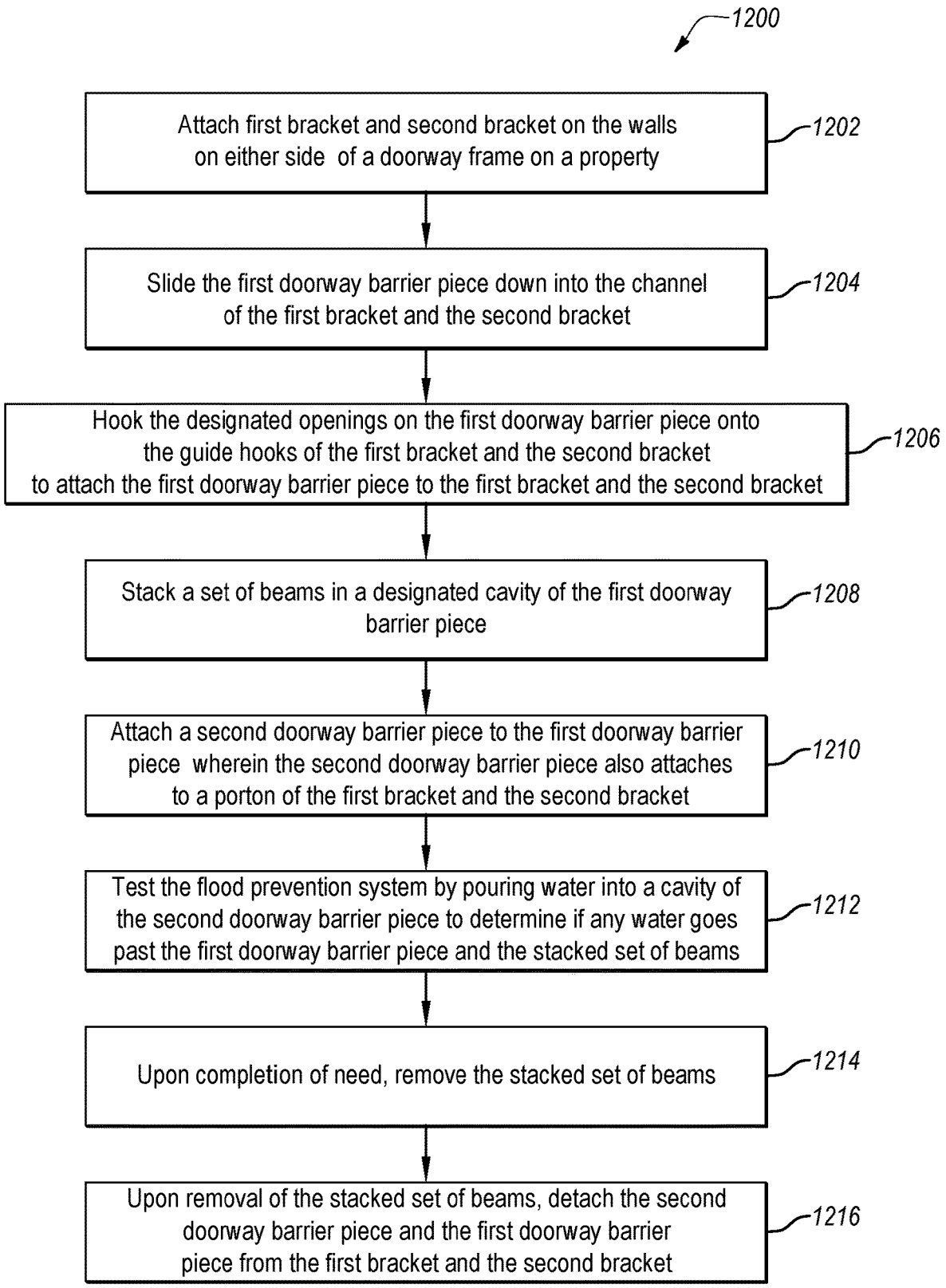
FIG. 12 is a flowchart of an exemplary method of using the flood prevention system.

FIG. 12 is a flowchart describing an exemplary method of using the flood prevention system 100. In a non-limiting embodiment, the method 1200 shown in FIG. 12 may include at step 1202 attaching a first bracket 110 to a first property wall 104 of the property 102 and attaching a second bracket 120 to a second property wall 106 of the property 102. At step 1204, the method 1200 may further include sliding or otherwise positioning the first doorway barrier piece 1204 down into the hollow channel 412 of the first bracket 110 and the second bracket 120. At step 1206, the method may also include hooking the designated openings 502*a*, 502*b*, 502*c*, 502*d*, 502*e*, and 502*f* (e.g., as shown in FIGS. 5-6) of the first doorway barrier piece 108 onto the guides/pegs 418*a*, 418*b*, and 418*c* of the first bracket 110 and the second bracket 120 in order to attach the first doorway barrier piece 118 to the first bracket 110 and the second bracket 120.

At step 1208, the user may next stack a set of beams 124 in the designated opening or channel 508 of the first doorway barrier piece 118 up to the top edge 503 of the panel 204 of the first doorway barrier piece 118. Alternatively, it is noted that the addition of the beams 124 may happen after steps 1210 when the second doorway barrier piece 122 is coupled to the first bracket 110 and second bracket 122 and to the first doorway barrier piece 118.

At step 1210, as shown in FIG. 12, the second doorway barrier piece 122 is removably attached to the first doorway barrier piece 118 as shown in FIG. 9 and in FIG. 10, whereby the bottom rail 704 of the second doorway barrier piece 122 couples with the bottom rail 206 of the first doorway barrier piece 118 and the second doorway barrier piece 122 has dedicated peg hole openings 712*a*-712*f* that hook onto the pegs 418*d*, 418*e*, 418*f* that extend down the front side 408 of the front piece 405 of the first bracket 110 and the second bracket 120. As noted above, additional beams 124 may be inserted and stacked into the cavity 804 of the second doorway barrier piece 122 to provide further strong support from the flood water 130 easily flowing past the flood prevention system 100.

At step 1212, in addition to the above, the user may want to pour water into the cavity 804 of the second doorway barrier piece 122 in order to further test the flood prevention system 100 to see if any water goes past the first doorway barrier piece 118, the set of beams 124, seals 126, and brackets 110, 120 into the property 102.

As shown at step 1214, upon completion of user or need, the user may remove the stacked set of beams 124. It is noted that each beam 124 should be easier to remove after a flood has occurred and flood water 130 being present on the property 102 than a soaked sandbag, which is the current standard apparatus used to block most doorways 108 in the event of flooding. This is a definite advantage for anyone who does not have the strength or ability to move and carry heavy sandbags.

At step 1216, the user may detach the second doorway barrier piece 122 and the first doorway barrier piece 118 by unhooking the portions of each that are hooked onto each other (i.e., via bottom rails 206 and 704) and onto the first bracket 110 and the second bracket 120. Next, the user may store all the components together within each other in a safe location until further future use arises. The brackets 110 and 120 may be permanently attached to the first wall 104 and the second wall 106, which will further prevent water from seeping past the brackets 110 and 120.

There are many advantages and uses are offered by the one or more systems described herein. The flood prevention system 100 can be installed on multiple areas of a property 102 where there are doors 109. The flood prevention system 100 may be made of lightweight materials, including but not limited to plastic, metal, wood, and/or a combination thereof. The flood prevention system 100 may be configured into various sizes and dimensions to accommodate doorways 108 of different widths and styles. It is noted that while FIG. 2 and FIG. 3 show a single pane door 109, the flood prevention system 100 may be configured whereby the W1 of the flood prevention system 100 extends past two door panels 109 or more. The flood prevention system 100 may thus be made to be modular and accommodate a variety of doorway 108 sizes and designs.

Many other advantages are offered by the system as described above.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components. The term "set" may mean one item or a plurality of items.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A method of using a flood prevention system comprising:

providing the flood prevention system, the flood prevention system comprising:

a first doorway barrier piece comprising:

a solid first doorway barrier piece panel; and a first doorway barrier piece bottom rail attached to a lower end of the first doorway barrier piece panel, wherein a first doorway barrier piece channel is formed between the first doorway barrier piece bottom rail and the first doorway barrier piece panel, wherein the first doorway barrier piece channel is configured to receive a plurality of beams useful in preventing flood water from entering through a doorway;

a second doorway barrier piece comprising:

a solid second doorway barrier piece panel having a first side support on a left side and a second side support on a right side of the solid second doorway barrier piece panel; and a second doorway barrier piece bottom rail with a second doorway barrier piece bottom rail channel extending through the second doorway barrier piece bottom rail between a front surface of the solid second doorway barrier piece panel and the second doorway barrier piece bottom rail;

a first bracket attachable to a first property wall adjacent to a left side of a door and/or a doorway frame, the first bracket comprising:

a back piece;

a front L-shaped piece, wherein a back edge of the front L-shaped piece is joined or otherwise formed and attached to approximately a centerline of the back piece, wherein the back piece of the first bracket has a first bracket exterior side and a first bracket interior side;

wherein a plurality of holes is spaced in vertical alignment on a first portion of the back piece of the first bracket;

wherein a first set of pegs in vertical alignment are spaced on a front side of a front post of the front L-shaped piece;

wherein a second set of pegs are spaced in vertical alignment on a front side of the first bracket interior side;

wherein a first bracket channel is formed in between the front side of the front post of the front L-shaped piece and the first bracket interior side, wherein the first bracket channel is configured to face towards a left side of the first doorway barrier piece;

a second bracket attachable to a second property wall adjacent to a right side of the door and/or the doorway frame, the second bracket comprising:

a back piece;

a front L-shaped piece, wherein a back edge of the front L-shaped piece is joined or otherwise formed and attached to approximately a centerline of the back piece, wherein the back piece of the first bracket is divided into a first bracket exterior side and a second bracket interior side;

wherein a plurality of holes is spaced in vertical alignment on a first portion of the back piece of the second bracket;

wherein a first set of pegs in vertical alignment are spaced on a front side of a front post of the front L-shaped piece;

wherein a second set of pegs are spaced in vertical alignment on a front side of the second bracket interior side;

wherein a second bracket channel is formed in between the front side of the front post of the front L-shaped piece and the second bracket interior side, wherein the second bracket channel is configured to face towards a right side of the first doorway barrier piece;

attaching the first bracket to the first property wall adjacent to the left side of the door and/or doorway frame;

attaching the second bracket to the second property wall adjacent to the right side of the door and/or doorway frame;

sliding the first doorway barrier piece into the first bracket channel and into the second bracket channel;

after sliding the first doorway barrier piece into the first bracket channel and into the second bracket channel, hooking a first set of designated openings on a left side member of the first doorway barrier piece onto the second set of pegs of the first bracket and hooking a second set of designated openings on a right side member of the first doorway barrier piece onto the second set of pegs of the second bracket;

stacking the plurality of beams into the first doorway barrier piece bottom rail channel of the first doorway barrier piece;

attaching the second doorway barrier piece further comprising hooking a first set of designated openings of the second doorway barrier piece for each side member of the second doorway barrier piece onto the first set of pegs of the first bracket and onto the first set of pegs of the second bracket, such that the second doorway barrier piece bottom rail of the second doorway barrier piece is facing a frontside of the first doorway barrier piece bottom rail;

testing the flood prevention system by pouring water into the second doorway barrier piece bottom channel of the second doorway barrier piece bottom rail to determine if any water goes past the first doorway barrier piece and past the plurality of beams; and keeping both the first doorway barrier piece with the plurality of beams positioned against the door and/or doorway as well as the second doorway barrier piece that is removably attached to the first doorway barrier piece, wherein the first doorway barrier piece extends past a width of the door and/or doorway.

2. The method of claim 1, further comprising, upon completion of the use of the flood prevention system, removing the plurality of beams and detaching the second doorway barrier piece from the first doorway barrier piece and removing the first doorway barrier piece, wherein the first bracket remains attached to the first property wall adjacent to a left side of the door and/or the doorway frame and the second bracket remains attached to the second property wall adjacent to the right side of the door and/or the doorway frame.

3. The method of claim 2, wherein the plurality of beams are storable within the first doorway barrier piece bottom rail and/or within the second doorway barrier piece bottom rail upon completion of the use of the flood prevention system.

4. The method of claim 1, wherein a frontside of the second doorway barrier piece bottom rail hooks onto the frontside of the first doorway barrier piece bottom rail.

5. The method of claim 1, wherein when installed, the front surface of the second doorway barrier panel piece faces towards a front surface of the first doorway barrier panel piece.

6. The method of claim 1, wherein when installed, a rear surface of the second doorway barrier panel is visible from an external viewpoint and wherein the door and/the doorway are blockaded by both the first doorway barrier piece and the second doorway barrier piece and the plurality of beams.

7. The method of claim 1, wherein the first bracket and the second bracket are not attached to the door and/or the doorway when installed.

8. A flood prevention system comprising:

a first doorway barrier piece, the first doorway barrier piece comprising:

a first doorway barrier piece panel having a left side and a right side, the left side and the right side comprising a first set of peg holes spaced apart from each other in a vertical orientation along the left side and the right side; and a bottom rail, wherein the bottom rail is attached or integrally formed with the first doorway barrier piece panel, and wherein the left side and the right side of the first doorway barrier piece panel extend past each terminal end of the base rail, wherein a set of pegs in horizontal alignment are included on a front side of the bottom rail, wherein the bottom rail comprises a hollow channel and a front piece that extends laterally along a front side of the back surface, wherein the hollow channel is configured to receive a set of beams that are removably storable within the hollow channel of the bottom rail of the first doorway barrier piece;

a second doorway barrier piece, the second doorway piece comprising:

a second doorway barrier piece panel;

a second doorway barrier piece left side member;

a second doorway barrier piece right side member;

a second doorway barrier piece bottom rail, wherein the second doorway barrier piece left side member, the second doorway barrier piece right side member, and the second doorway barrier piece bottom rail are positioned in front of the second doorway barrier piece panel such that a channel is present between the second doorway barrier piece left side member, the second doorway barrier piece right side member, and the second doorway barrier piece bottom rail and a back surface for the second doorway barrier piece;

a set of second doorway barrier piece peg holes included on the second doorway barrier piece left side member and on the second doorway barrier piece right side member;

a set of second doorway barrier peg holes distributed in horizontal alignment on a front surface of the second doorway barrier piece bottom rail;

a first bracket attachable to a first property wall adjacent to a left side of a door and/or a doorway frame, the first bracket comprising:

a back piece;

a front L-shaped piece, wherein a back edge of the front L-shaped piece is joined or otherwise formed and attached to approximately a centerline of the back piece, wherein the back piece of the first bracket has a first bracket exterior side and a first bracket interior side;

wherein a plurality of holes are spaced in vertical alignment on a first portion of the back piece of the first bracket;

wherein a first set of pegs in vertical alignment are spaced on a front side of a front post of the front L-shaped piece;

wherein a second set of pegs are spaced in vertical alignment on a front side of the first bracket interior side;

wherein a first bracket channel is formed in between the front side of the front post of the front L-shaped piece and the first bracket interior side, wherein the first bracket channel is configured to face towards the left side of the first doorway barrier piece;

a second bracket attachable to a second property wall adjacent to a right side of the door and/or the doorway frame, the second bracket comprising:

a back piece;

a front L-shaped piece, wherein a back edge of the front L-shaped piece is joined or otherwise formed and attached to approximately a centerline of the back piece, wherein the back piece of the first bracket is divided into a first bracket exterior side and a second bracket interior side;

wherein a plurality of holes are spaced in vertical alignment on a first portion of the back piece of the second bracket;

wherein a first set of pegs in vertical alignment are spaced on a front side of a front post of the front L-shaped piece;

wherein a second set of pegs are spaced in vertical alignment on a front side of the second bracket interior side;

wherein a second bracket channel is formed in between the front side of the front post of the front L-shaped piece and the second bracket interior side, wherein the second bracket channel is configured to face towards a right side of the first second doorway barrier piece;

wherein the first doorway barrier piece is removably attachable to the first bracket interior side and rests within the first bracket channel of the first bracket and is removably attachable to the second bracket interior side and rests within the second bracket channel of the second bracket, wherein the second doorway barrier piece is removably attachable to the front side of the front post of the front L-shaped piece of the first bracket and removably attachable to the front side of the front post of the front L-shaped piece of the second bracket, wherein the second doorway barrier piece is oriented such that a front side of the second doorway barrier piece is facing towards a front side of the first doorway barrier piece, wherein a front side of the second doorway barrier piece bottom rail is removably hooked or otherwise positioned onto a front side of the first doorway barrier piece.

9. The flood prevention system of claim 8, wherein the first bracket and the second bracket and the first doorway barrier piece and the second doorway barrier piece are not attachable to the door or to the doorway frame.

10. The flood prevention system of claim 8, wherein the first doorway barrier piece panel hooks onto the first bracket and onto the second bracket.

11. The flood prevention system of claim 10, wherein the first set of peg holes on the left side of the first doorway barrier piece panel hook onto the second set of pegs on the front side of the first bracket interior side of the first bracket and wherein the first set of peg holes on the right side of the first doorway barrier piece panel hook onto the front side of the second bracket interior side of the second bracket.

12. The flood prevention system of claim 8, wherein the set of second doorway barrier piece peg holes on the second doorway barrier piece left side member hook onto the first set of pegs on the front side of the front post of the front L-shaped piece of the first bracket and wherein the set of second doorway barrier piece peg holes on the second doorway barrier piece right side member hook onto the first set of pegs on the front side of the front post of the front L-shaped piece of the second bracket.

13. The flood prevention system of claim 8, wherein the set of second doorway barrier peg holes on the front surface of the second doorway barrier piece bottom rail hook into the set of pegs in horizontal.

* * * * *